US006092581A

United States Patent [19]

Andersson

[11] Patent Number: 6,092,581

[45] Date of Patent: Jul. 25, 2000

[54] SAFETY BLIND FOR WINDOWS AND DOORS

[75] Inventor: Hans Andersson, Alingsås, Sweden

[73] Assignee: AnSa Protection AB, Sweden

[21] Appl. No.: 08/973,651

[22] PCT Filed: Jun. 18, 1996

[86] PCT No.: PCT/SE96/00792

§ 371 Date: Mar. 4, 1998

§ 102(e) Date: Mar. 4, 1998

[87] PCT Pub. No.: WO97/01015

PCT Pub. Date: Jan. 9, 1997

[30] Foreign Application Priority Data

Jun. 22, 1995 [SE] Sweden ..... 9502273

[51] Int. Cl.[7] ..... A47H 3/00

[52] U.S. Cl. ..... 160/268.1; 160/266

[58] Field of Search ..... 160/27, 35, 266, 160/268.1, 269, 231.1, 237, 248, 262, 290.1, 273.1

[56] References Cited

U.S. PATENT DOCUMENTS 1,370,324 3/1921 Lafuente .

3,516,470 6/1970 Kurz .

FOREIGN PATENT DOCUMENTS 632947 1/1928 France .
182580 4/1907 Germany .
24 44 135 3/1976 Germany .
34 08 989 A1 9/1985 Germany .
44 39 589 A1 5/1995 Germany .

*Primary Examiner*—Daniel P. Stodola
*Assistant Examiner*—Bruce A. Lev
*Attorney, Agent, or Firm*—Lerner, David, Littenberg, Krumholz & Mentlink, LLP

[57] ABSTRACT

Safety blinds for installation in an opening in a building such as a door or window includes a closure covering the opening, a plurality of projections along the side edges of the opening and a plurality of corresponding apertures along the side edges of the closure, whereby locking the projections into the openings prevents the closure from opening and also prevents the side edges of the closure from being displaced from the side edges of the opening. In another embodiment, the projections from the closure cooperate with a continuous channel along the edge of the opening whereby the projections can move within the channel for opening and closing the closure and can be locked in position for again preventing the closure from being opened.

14 Claims, 4 Drawing Sheets

SAFETY BLIND FOR WINDOWS AND DOORS

TECHNICAL FIELD

The present invention relates to a roller blind for windows, doors and other similar closure means particularly in buildings.

BACKGROUND OF THE INVENTION

Different types of devices, which can be opened, are used as protection from view, for screening of sun rays and, sometimes, as reinforced burglary protection. Apart from the main type windows or doorshutters, there is another main type where screening devices are pulled or rolled down in front of the opening in the window or door, respectively, and which distinguishes itself from curtains and drapes by being, in general, of a stronger material than textile and arranged with a more technically emphasised closing mechanism. Such devices are generally called Venetian blinds or roller blinds, which last designation will be used here.

Many types of roller blinds have the only task of functioning as protection from view and sunscreens, and do not need to be of any more robust construction. Certain types, on the other hand, are intended to also function as reinforced burglary protection or, for some types, only as such. As an example, ribbed blinds can be mentioned, which are generally found in areas with a strong solar radiation and which, because the closure device is made of wood or steel ribs running in rails, cause a certain amount of hindrance during an attempted burglary. They do, however, form heavy and relatively bulky structures and require relatively large adaptations of the building construction for their installation. Another increasingly common type is represented by grid constructions, which can be pulled or rolled in front of the opening in a building. They are mainly used in public environments, such as for shop windows, entrances to shops or institutions, for subways etc. These constructions are relatively bulky too and are also expensive to manufacture because they consist of a great number of parts which have to be attached to each other in a flexible manner.

SUMMARY OF THE INVENTION

The object of the present invention is to provide a roller blind which can be used as protection from view and as a sunscreen and which, at the same time, is resistant to penetration and which can be adequately locked. At the same time, the object is to provide a roller blind which requires such small space that it can be installed on the inside of windows and doors without any significant adaptation of the building construction and which can also be hidden under a conventional curtain arrangement when in the opened state. The goal is also that it shall have such a design that it can be manufactured at such low cost that it can also be used in private settings where the cost factor is of greater importance than in a business context.

The previous account of the state of the art and the resulting products available show that no product exists which has a considerably enhanced resistance to burglary whilst still being suitable for installation in ordinary homes. The previous availability of devices having an enhanced resistance to burglary has been aimed totally, on one hand, towards the first-mentioned, which are installed and taken into account during the construction of the building, and, on the other hand, towards such intended for protection of public environments. None of these types is suitable for subsequent installation after construction in ordinary dwellings. On the other hand, there is a rising need of protection and burglary protection for dwelling s because of the increasing criminality and the ever more serious acts of violence.

The various objects of the invention are achieved by a simple and scarcely bulky but still resistant closure device together with an effective locking arrangement therefor in a closed position. The locking arrangement is adapted to secure the device along three edges whilst the device co-operates with its closure means along the fourth edge.

BRIEF DESCRIPTION OF THE DRAWINGS

The invention will be described in the following by means of two variations of one embodiment. Reference is made to the accompanying drawings, in which.

PREFERRED EMBODIMENT

Figure 1:
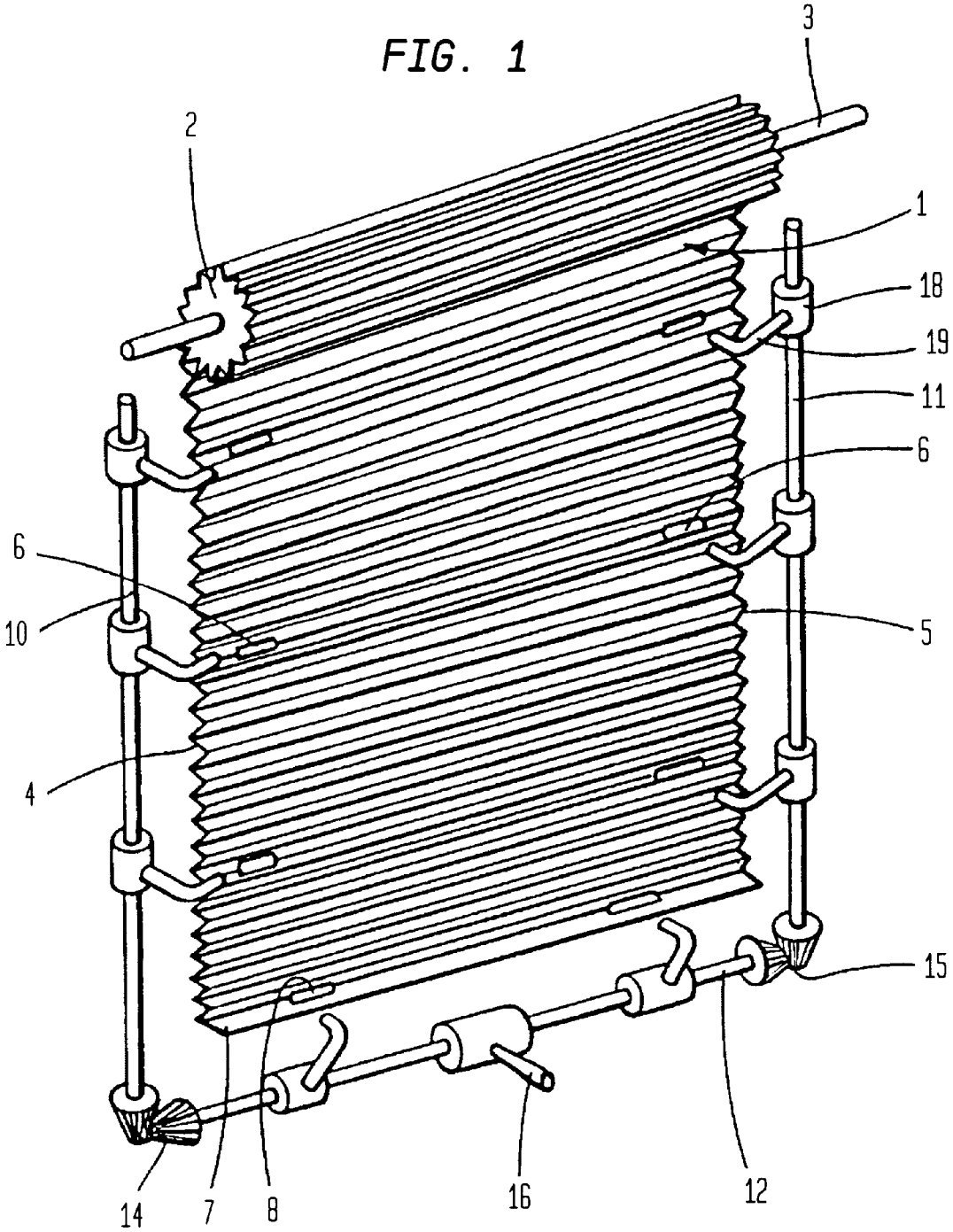
FIG. 1 is a schematic perspective view showing one main principle of the invention.

FIG. 1 shows, schematically, an important principle of the invention, this being a locking arrangement for the securing of the closure device in a closed position. The closure device is designated 1 and is here formed by a folded length of a resilient, resistant material. A suitable material is thin sheet metal, preferably stainless steel plate. For the coiling of the device 1 there is arranged a core 2 which is rotatably supported in a not shown bearing by means of an axle 3. The axle 3 is, together with the core 2, arranged to be rotated so that the device 1 is coiled onto the core or uncoiled from the same to the closing position shown in FIG. 1. It is consequently assumed that the core 2 with its bearings is arranged to cover the opening which is to be closed.

Holes 6 are arranged along the device's 1 side edges 4 and 5 and, along its bottom edge 7, there is arranged a hole 8. Locking means in the form of two shafts 10 and 11, and are arranged along the side edges 4 and 5 along the bottom edge 7 there is arranged a shaft 12. Conical gear drives 14 and 15 are placed between the ends of the shaft 12 and the shaft 10 and 11, respectively. The shaft 12 is arranged to be rotated by a control device 16. The movement of the shaft 12 is transmitted via the gear drives 14, 15 to the shaft 10, 11.

Non-rotatably arranged on each of the shafts are catch members 18 with hooks 19. When the device 1 is in a closed position the holes 6 and 8 are in such a position that, when the shafts 10-12 are rotated during their co-ordinated movement, the catch members 18 will be turned so that the hooks 19 will be inserted in the holes 6 and 8.

By means of the engagement of the hooks 19, the device 1 will be efficiently held at the side edges and the bottom edge, while the upper edge is firmly associated with the core 2.

During an attempt to break through the closure device 1, it will either have to be opened by cutting it up or tearing its side and bottom edges loose from the engagement with the hooks 19, or, if the bottom edge is not loosened, from the core 2. If the described locking means itself is made to withstand large forces, then the only possibility to penetrate the device is by somehow breaking it to pieces. With such a tough material as a hard steel, this will imply considerable difficulties.

In FIG. 1 this locking principle is shown in an overview and a variation showing the complete, preferred embodiment, will be described in more detail in the following.

Figure 2A:
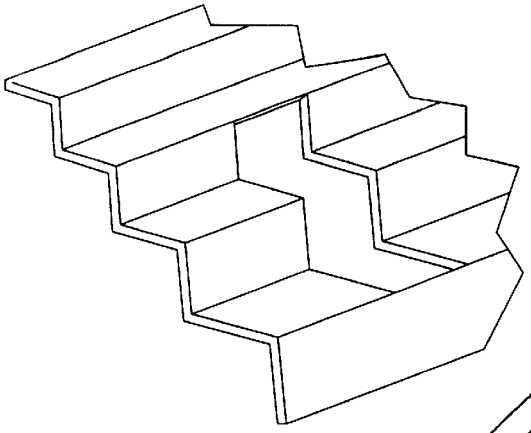
FIG. 2 is a perspective view of the closing means of the roller blind.
Figure 2:
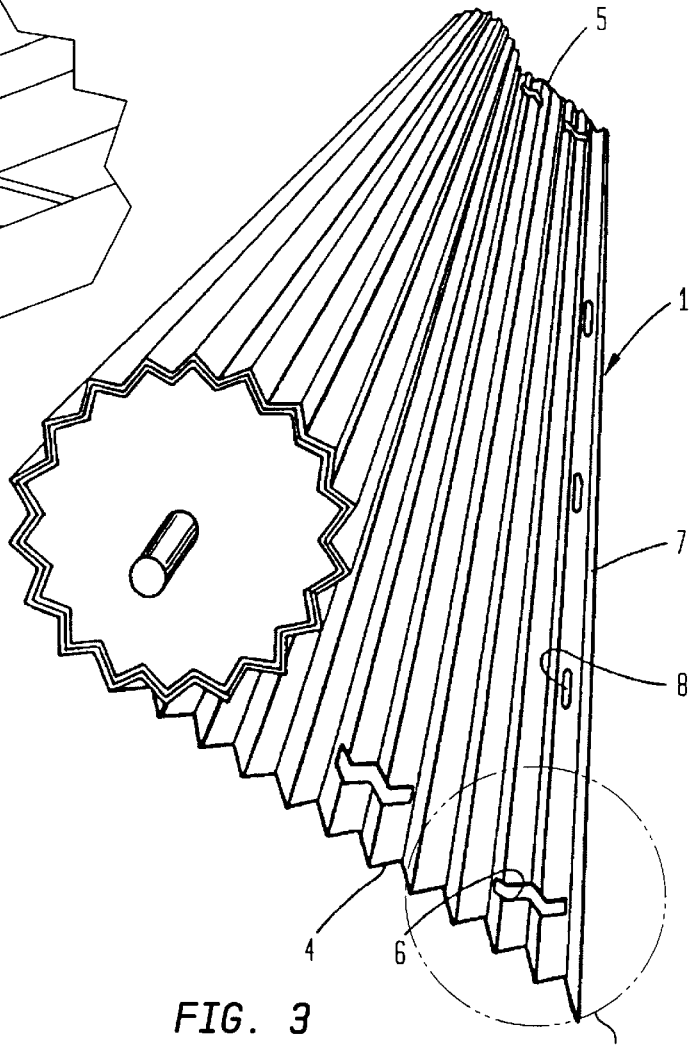

FIG. 2 shows the closure device 1 with its side edges 4, 5 and bottom edge 7, and the holes 6 and 8, respectively, for the catching hooks. As is evident from the drawing, the device 1 comprises a thin, folded material, which can be coiled onto the core, which here is assumed to have a cog-shape corresponding to the folds. It is advantageous if the folds are designed with a varying spacing, which is adapted to the increase of the roll diameter during coiling of the device. The outermost, top edge of the device is fastened in a satisfactory manner to the core, e.g. by screwing or insertion in a groove which grips the end part of the device, which, in this case, can be folded.

Figure 3:
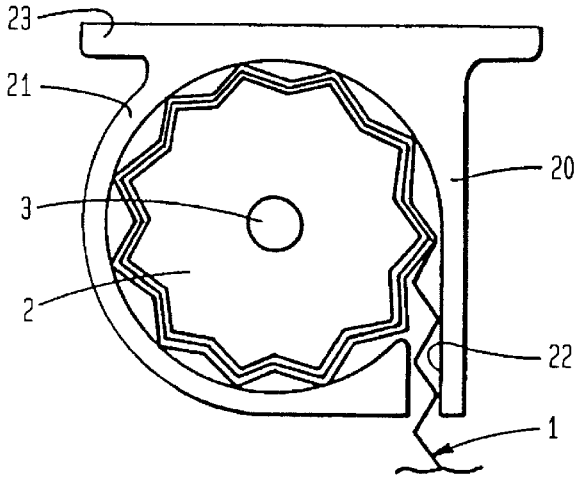
FIG. 3 shows a cross section through the closing means and a cartridge for the same.

As previously mentioned, it should be possible to install the roller blind on a wall, preferably on the inside, so that it can cover a wall opening for, e.g. a window, a window door or a door. The axle 3 is then supported above the opening. This can be accomplished using end pieces which are associated with the core's 2 ends and constitute supports for the axle 3. One of the end pieces can, in addition, carry a rotation means for the axle 3. An end piece of this type is shown in a horizontal cross sectional view in FIG. 3 it is apparent that the end piece, designated 20, extends a distance in over the width of the device or that the end pieces are joined, like a cartridge, to enclose the entire core and the coiled up device. Thus, irrespective of whether the design is as end pieces or a whole cartridge, the core 2 is enclosed by a cylindrical wall 21 having an opening slot 22. The axle 3 is also shown in FIG. 3 and it is also indicated that it is arranged in the core as a square axle in order to rotate the core when the axle rotates. Between the core 2 and the inner surface of the wall 21 there is sufficient space for the device 1 to be rolled up onto the core along substantially its entire length. Since the folded device strives to spring out from the core, the shown enclosure, using the wall 21, is necessary for the device to be tightly rolled onto the core in order to minimise the need for space.

When uncoiling the device, the axle 3 should be rotated clockwise and anticlockwise when coiling. For this purpose a rotation means for operation by hand is arranged, e.g. via a worm gear and a torque arm directed downwards or via a gear drive motor. One end piece or one end of the cartridge, respectively, is thus arranged to support this rotation means. Furthermore, it is evident that the end piece/cartridge has a flange 23 with which installation to a ceiling or on a console can be easily accomplished.

Figure 4:
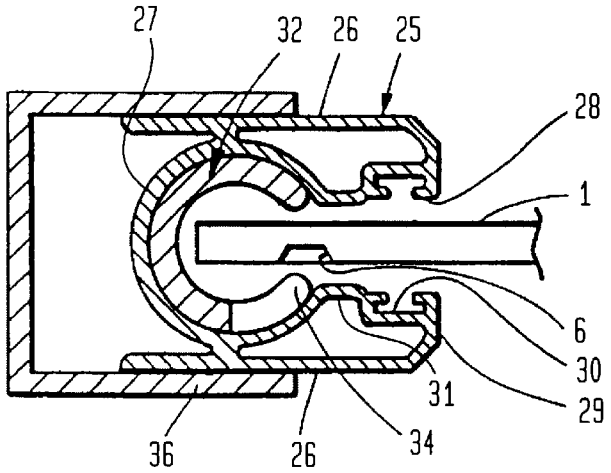
FIG. 4 shows, in a horizontal cross sectional view along line IV—IV in FIG. 1, the side part of the blind with a first variation of the locking arrangement.

In FIG. 4, an edge part of the roller blind is shown in a horizontal cross sectional view. It is evident that the folded closure device's 1 edge projects into a profile 25 which is fastened onto the wall next to the side edge of the opening. The profile has two substantially flat side parts 26 and a cylindrical part 27 which opens via a slot 28 in an end part. This end part has to be turned in towards the middle part of the device 1. In the slot 28 there is cut a groove 30 which has edge flanges on both sides. These grooves are intended to house slide strips of a material having a low friction, alternatively in brush design. The remainder of the profile 25 is most advantageously made of extruded aluminium.

In the cylindrical part 27 there is the earlier mentioned locking means arranged as a tubular locking rod 32 having a groove 31 from whose one edge teeth 34 protrude. The earlier mentioned holes 6 in the edge parts of the device 1 are in line with the locking rod's 32 circumference, which is facing the end part 29 in such a way that the teeth 34 can be swung into each of the respective holes 6 through rotation of the locking rod 32. This engagement is shown in FIG. 4. If the locking rod is rotated clockwise, the teeth 34 will be withdrawn from of the holes and the device 1 can run freely in the slot 28 during opening and lowering. In the engaged position, the teeth 34 very strongly hold the device 1 along its side edges such that the device can be neither raised nor lowered and can only be pulled out of the slot by means of very large forces. For maximum strength, the outer ends of the teeth have to sufficiently wrap over the slot edge in the locking position.

From FIG. 4 it is further evident that the profile 25 at its edge opposite to the end 29 runs in a U-profile 36 in which the profile 25, through e.g. drilled-in screws, can be secured at a depth which is adjusted during installation to always give the profile 25 the proper relative position to the device 1 and its holes 6, but still allows for the possibility to freely fasten the supporting profile 36 within certain limits in a position adapted to the width of the opening. The arrangement thus represents some type of telescopic device.

Figure 5:
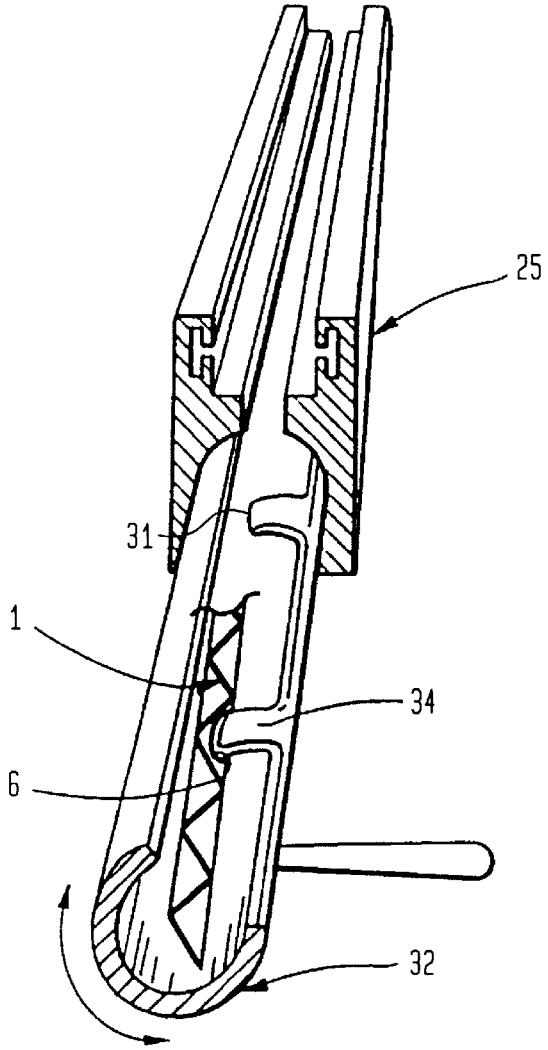
FIG. 5 is an perspective view of the side part.

In FIG. 5 a simplified overview is shown of how the teeth 34 co-operate with the device 1.

Figure 6:
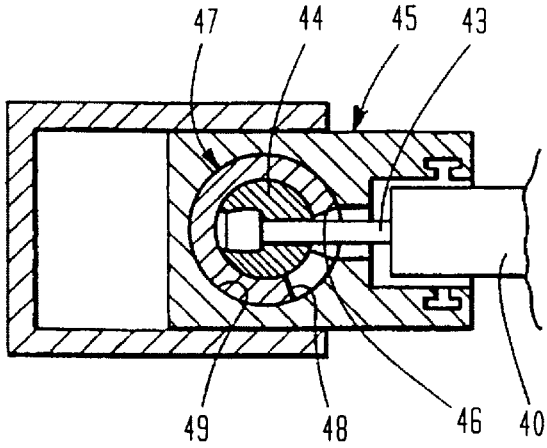
FIG. 6 shows, in a horizontal cross sectional view, a side part with the locking arrangement in a second variation.
Figure 7:
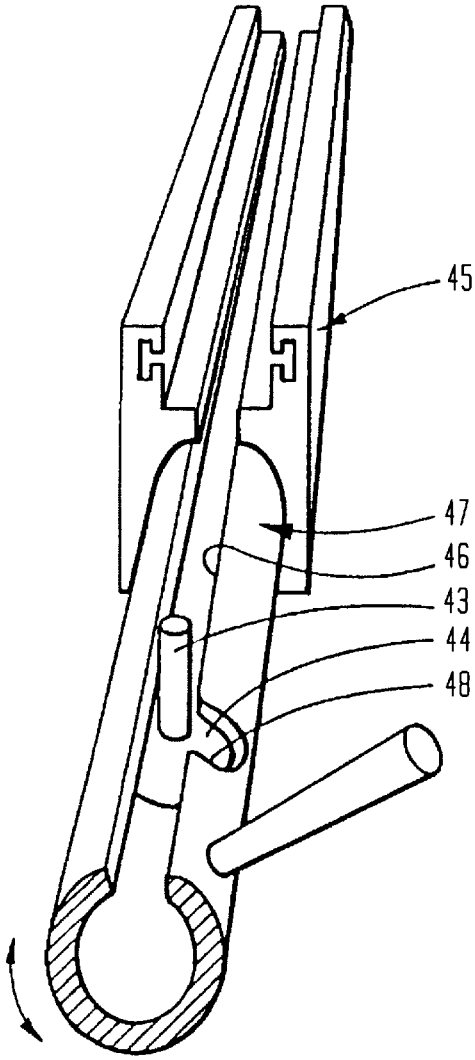
FIG. 7 is a perspective view of the locking arrangement according to FIG. 6.

In FIGS. 6 and 7 a second variation of the locking means is presented, which in its first variation is shown in detail in FIGS. 4 and 5. FIGS. 6 and 7 use the same mode of representation. The difference with the second variation is that the locking means does not directly engage the closure device, as in the first variation, in FIG. 6 designated by 40. Instead the locking positions of the closure device are attached to a strong joint of protruding pegs 43. These terminate in a projecting part 44, here shown as a ball, which is retained on the peg 43 by being threaded on to the same and fixed using a head on the end of the peg. As slides for the balls, there are provided locking means in the shape of tubular profiles 47, arranged at the respective edges of the closure device. These are placed in grooves 49 of an edge profile 45, with the profiles 47 arranged for turning such as has been previously described.

The tubular profile 47 which forms the locking means has a longitudinal groove 46 in which the pegs 43 can run during the raising and lowering of the closure device. This groove has recesses 48 in the intended locking positions.

As should have been evident the pegs 43 can run freely up and down together with the closure device when the locking profile 47 is in the position shown in FIGS. 6 and 7. If, however, the profile is turned so that the recesses 48 will embrace the pegs 43 when the closure device has been lowered and the pegs 43 are in a locking position, these will be prevented from movement in the longitudinal direction of the groove 46. In this way, opening of the closure device is prevented. Simultaneously, the projecting part in the shape of the ball 44 ensures that the pegs cannot be pulled out from the profile 45 should someone try to remove the closure device by pulling it perpendicularly out from the locking means. Strong resistance to such tampering requires that the peg 43 has a strong connection to the closure device and that its projecting part, such as the ball 44, is provided with a strong bond to the peg and a strong fixture to the locking means in the shape of the tubular profile 47.

Here it has been described hoe the edges of the closure device are locked using their respective locking means. The lower edge of the device is correspondingly locked by means of a profile, similar to the profile 25 and 45 respectively, which is placed in a horizontal position. Also here locking rods are present corresponding to the locking rods 32 and 47 respectively. All of the locking rods are synchronised with each other through some type of power transmission in the corner points between the lower locking rod and the two side rods. One of the locking rods, preferably the lower, has an actuating means, for example a rod or wheel with the aid of which the movement between locking position and open position can be performed. If so desired, the actuating means can be provided with a key lock or other safety block. The locking arrangements which have now been described in detail are based on the principle shown in FIG. 1. The shafts 10–12 in FIG. 1 thus serve the same purpose as the described turnable, tubular locking rods and their teeth and grooves respectively have the task that the hooks 19 schematically have been shown to have. The gear drives 14 and 15 are responsible for the synchronisation between the three locking arrangements, but they can be replaced with other movement means.

The mode of operation should have been evident from the preceding description. Here it can be mentioned, however, that the blind can be closed by rolling down the device 1 using the aforementioned rotation means. Locking is achieved using the described locking system. The lock is released during coiling and the rotation means is operated in the opposite manner.

One important object of a roller blind according to the invention is that it shall form strong protection against penetration so that reliable protection against burglary is obtained. To achieve this effect it is not sufficient that the blind be locked against opening. It also has to be protected from being pulled out with the edges which are movable during raising and lowering. This is achieved according to the invention because the closure device in the locking locations are in engagement with the locking means in such a manner that the edge to the closure device is held in all directions. This is accomplished with the first variation of embodiment of locking means because its catch members are inserted into the holes of the closure device when engaged with their edges thus being themselves secured against damage because they wrap over the groove in which the respective locking means is enclosed. This form of retention is especially suitable if the closure device, as in the embodiment, is designed as a relatively thin sheet which could easily be bent and pulled out of the side guides if these did not have engaging catch members. This provides an important possibility to have an embodiment with a closure device in this form which gives great advantages. On one hand, the closure element will be of a simple shape, it consists of only one part, the folded sheet, in contrast to the embodiment having segments secured to each other. It has also been shown that closure devices of this type are very difficult to penetrate on account of their flexibility; they can practically not be broken and the only way to open it is to cut it open. This flexibility results in, which has been mentioned, a risk of its deformation and removal from its guide means, which is something, however, that is effectively prevented with the invention as has been described.

With the second variation of embodiment of locking means, a similarly secure retention of the edges of the closure device is obtained in all directions by the mentioned rods with their protruding pegs and extending parts. This variation can be applicable if the closure device is designed as a folded sheet, but is especially applicable if the closure device has another design and is not suitable for perforation or does not run in the edge guides itself. In this case, a connection with the closure device is established in that it is provided with locking means in the form of pegs along its edges. The invention does not exclude, consequently, that the closure device has another design than shaped as a folded sheet as with the embodiment which is indicated solely as a preferred embodiment.

It should also be mentioned that the roller blind, instead of being folded from top to bottom, can be installed inverted or for a horizontal movement when closing and opening.

The detail design can, nevertheless and on the whole, be such as has been described earlier.

The invention is not limited to the description above nor to the examples shown in the drawings, but may be varied within the scope of the appended claims. For example, the blocking of the rotational movement of the extension 25 can be made in a different way, e.g. in the shape of one or more angled or coiling grooves in one piston member, which grooves co-operate with projections on the other piston member. The twisting means and the arrangement for activation of the brake can comprise conventional parts, for which reason they are not described further.

What is claimed is:

1. A safety blind for installation in an opening in a building including a pair of side edges and a bottom edge comprising a closure including a pair of side edges and a bottom edge and being movable between an open position and a closed position in which said closure can substantially cover said opening, a first plurality of locking lei, members disposable along said pair of side edges of said opening, and a second plurality of locking members disposed along said pair of side edges of said closure, lock means for relatively disposing said first and second pairs of locking members with respect to each other between a locked configuration and an unlocked configuration when said closure is in said closed position, said first plurality of locking members comprising locking apertures and said second plurality of locking members comprising projecting means for projecting through said locking apertures, said locking apertures having a predetermined width and connected by a continuous channel disposable along said pair of side edges of said opening, said projecting means comprising a plurality of pegs projecting from said pair of side edges of said closure into said continuous channel, said plurality of pegs each including an enlarged peg portion having a size greater than said predetermined width but smaller than the width of said continuous channel, whereby said enlarged peg portion can freely move within said continuous channel and cannot pass through said locking apertures, and said lock means comprising a movable channel inlet closure member including a plurality of grooves corresponding to said plurality of pegs, said movable channel inlet closure member being movable between said locked configuration whereby said locking apertures are substantially covered and said pegs are thereby prevented from moving along said continuous channel and said unlocked position wherein said pegs can freely move along said continuous channel and said closure can move between said open and closed positions.

2. The safety blind of claim 1 wherein said first plurality of locking members are also disposable along said bottom edge of said opening and said second plurality of locking members are also disposed along said bottom edge of said closure, whereby when said locking means is in said locked configuration said projecting means can also prevent said bottom edge of said closure from being displaced from said bottom edge of said opening.

3. The safety blind of claim 1 wherein said one of said first and second plurality of locking members comprises said first plurality of locking members and said other of said first and second plurality of locking members comprises said second plurality of locking members.

4. The safety blind of claim 3 wherein said lock means comprises a continuous channel disposed along said pair of side edges of said opening, said continuous channel including said locking apertures having a predetermined width, said projecting means comprising a plurality of pegs projecting from said pair of side edges of said closure through said locking apertures into said continuous channel, said plurality of pegs each including an enlarged peg portion having a size greater than said predetermined width but smaller than said size of said continuous channel whereby said enlarged peg portion can freely, move within said continuous channel but cannot pass through said locking apertures, and said lock means including a movable channel inlet closure member including a plurality of grooves corresponding to said plurality of pegs, said movable channel inlet closure member being movable between said locked configuration whereby said locking apertures are substantially covered except for said plurality of grooves and said pegs are thereby prevented from moving along said continuous channel and said unlocked position wherein said pegs can freely move along said continuous channel and said closure can move between said open and closed positions.

5. The safety blind of claim 1 wherein said lock means is associated with said first plurality of locking members, and comprises a continuous channel disposable along said pair of side edges of said opening, said continuous channel including a continuous channel opening having a predetermined size, and a rotatable channel member disposed within said continuous channel, said rotatable channel member including a channel member groove, whereby said pair of side edges of said closure can freely move along said channel member groove.

6. The safety blind of claim 5, wherein said one of said first and second plurality of locking members comprises said second plurality of locking members and said other of said first and second plurality of locking members comprises said first plurality of locking members.

7. The safety blind of claim 1 wherein said closure comprises a continuous flexible sheet.

8. The safety blind of claim 7 wherein said closure is adapted to be rolled up in order to move between said open and closed positions.

9. A safety blind for installation in an opening in a building including a pair of side edges and a bottom edge comprising a closure comprising flexible sheet metal including a pair of side edges, a top edge, and a bottom edge, said closure being adapted to be rolled up in order to move between an open position and a closed position in which said closure can substantially cover said opening, said flexible sheet metal including a plurality of folds extending perpendicular to said pair of side edges of said closure, the distance between said plurality of folds decreasing from bottom edge toward said top edge a first plurality of locking members disposable along said pair of side edges of said opening, a second plurality of locking members disposed along said pair of side edges of said closure, lock means for relatively disposing said first and second pair of locking members with respect to each other between a locked configuration and an unlocked configuration when said closure is in said closed position, one of said first and second plurality of locking members comprising locking apertures and said other of said first and second plurality of locking members comprising projecting means for projecting through said locking apertures, whereby when said lock means is in said locked configuration said projecting means projects through said locking apertures and prevents said closure from moving into said open position and can simultaneously prevent said pair of side edges of said closure from being displaceable from said pair of side edges of said opening.

10. The safety blind of claim 9 wherein said plurality of folds are spaced apart from each other a distance which increases towards said bottom edge of said closure whereby said plurality of folds can tightly mesh with each other upon rolling up of said closure.

11. The safety blind of claim 9 wherein said closure is adapted to be rolled up in order to move between said open and closed positions.

12. The safety blind of claim 9 wherein said lock means is associated with said first plurality of locking members, and comprises a continuous channel disposable along said pair of side edges of said opening, said continuous channel including a continuous channel opening having a predetermined size, and a rotatable channel member disposed within said continuous channel, said rotatable channel member including a channel member groove, whereby said pair of side edges of said closure can freely move along said channel member groove.

13. A safety blind for installation in an opening in a building including a pair of side edges and a bottom edge comprising a closure including a pair of side edges and a bottom edge and being movable between an open position and a closed position in which said closure can substantially cover said opening, a first plurality of locking members disposable along said pair of side edges of said opening, a second plurality of locking members disposed along said pair of side edges of said closure, and lock means associated with said first plurality of locking members, for relatively disposing said first and second pair of locking members with respect to each other between a locked configuration and an unlocked configuration when said closure is in said closed position, said lock means comprising a rotatable channel member disposed within a continuous channel, said rotatable channel member including a channel member groove, whereby said pair of side edges of said closure can freely move along said channel member groove, one of said first and second plurality of locking members comprising locking apertures and said other of said first and second plurality of locking members comprising projecting means for projecting through said locking apertures, said locking apertures comprising a continuous channel disposable along said pair of side edges of said opening, sail continuous channel including a continuous channel opening having a predetermined size, whereby when said lock means is in said locked configuration said projecting means projects through said locking apertures and prevents said closure from moving into said open position and can simultaneously prevent said pair of side edges of said closure from being displaceable from said pair of side edges of said opening.

14. The safety blind of claim 13 wherein said closure comprises a continuous flexible sheet.

* * * * *

UNITED STATES PATENT AND TRADEMARK OFFICE

CERTIFICATE OF CORRECTION

PATENT NO. : 6,092,581

DATED : July 25, 2000

INVENTOR(S) : Anderson

It is certified that error appears in the above-identified patent and that said Letters Patent is hereby corrected as shown below:

Title Page, under Attorney, Agent, "Mentlink" should read --Mentlik--

Col. 2, line 3, "dwelling s" should read --dwellings--.

Col. 3, line 34, "3 it" should read --3. It--

Col. 6, line 34, delete "lei".

Col. 7, line 20, after "freely" delete --,--.

Col. 7 line 61, after "from" insert --said--.

Col. 7, line 62, after "edge" insert --,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*